United States Patent [19]

Kolk et al.

[11] 4,201,516

[45] May 6, 1980

[54] IMPELLER FOR A CENTRIFUGAL MACHINE

[75] Inventors: Michael R. Kolk, Export; Ralph E. Beck, Jeannette; Roy E. Hoyle, Greensburg, all of Pa.

[73] Assignee: Carrier Corporation, Syracuse, N.Y.

[21] Appl. No.: 913,622

[22] Filed: Jun. 8, 1978

[51] Int. Cl.[2] ..... F01D 5/30; B21K 3/04

[52] U.S. Cl. ..... 416/213 R; 29/156.8 CF

[58] Field of Search ..... 416/213 R, 213 A, 185; 29/156.8 CF

[56] References Cited

U.S. PATENT DOCUMENTS

| | | | |
|---|---|---|---|
| 1,904,421 | 4/1933 | Doran | 416/213 R |
| 2,143,466 | 1/1939 | Allard | 416/213 R |
| 2,166,998 | 7/1939 | Morgan | 416/213 R |
| 2,773,169 | 12/1956 | Lees | 416/213 R |
| 4,096,615 | 6/1978 | Cross | 416/213 R |

FOREIGN PATENT DOCUMENTS

| | | | |
|---|---|---|---|
| 238024 | 9/1945 | Switzerland | 416/213 R |

*Primary Examiner*—Leonard E. Smith

*Attorney, Agent, or Firm*—J. Raymond Curtin; Barry E. Deutsch

[57] ABSTRACT

An impeller for a centrifugal machine includes a hub having at least one slot formed therein. A blade is mounted in the slot with the leading edge of the blade comprised of a relatively thin top section in contact with the fluid flowing through the machine, and a relatively thick bottom section for insertion into the slot. The blade is welded to the hub at the interface of said thick bottom section and the hub.

2 Claims, 5 Drawing Figures

IMPELLER FOR A CENTRIFUGAL MACHINE

BACKGROUND OF THE INVENTION

This invention relates to an impeller for a centrifugal machine, and in particular, to an impeller having the blades thereof welded to the impeller's hub.

The manufacture and use of welded impellers in centrifugal machines, such as centrifugal compressors and pumps, has been utilized for many years. Typically, the blades of the impeller wheel have been placed over slots formed in the impeller hub, with the blade thereafter being welded to the hub at the blade-hub interface.

The shape of the blades employed in a centrifugal machine are generally contoured to achieve the best aerodynamic performance. In particular, the leading edge of the blade, that is the portion of the blade first contacting the medium flowing through the machine, is generally of a relatively small thickness when compared to the thickness of the remaining portion of the blade. Problems have sometime occurred in welding the blade to the hub, and in particular, the problems have generally been concentrated in the vicinity of the leading edge of the blade. Such problems have arisen as a result of attempts to weld a relatively thin section of the leading edge of the blade whereby, in some cases, the leading edge has been damaged or in severe cases destroyed by burning such edge during the welding process. In addition, in relatively small impellers, the flow passage defined by adjacent blades is also relatively narrow, making such passage particularly susceptible to becoming clogged by weld material. In view of the foregoing problems, it is extremely desirable to achieve a new method for manufacturing a welded impeller.

Even with relatively large size impellers, the present invention achieves a cost advantage over the prior art arrangement by reducing or eliminating the grinding step necessary to remove weld material deposited in the flow passages.

SUMMARY OF THE INVENTION

It is accordingly an object of this invention to manufacture an improved impeller by welding the blades of the impeller to the hub.

It is a further object of this invention to retain the aerodynamic characteristics of an impeller, yet permit welding the blades to the impeller's hub without damage thereto.

It is a further object of this invention to design a blade for an impeller which can be satisfactorily attached to the hub by a welding process.

These and other objects of the present invention are obtained in an impeller for a centrifugal machine having a hub with at least one slot formed therein. A blade for mounting in the slot has its leading edge comprised of a relatively thin top section in contact with the fluid flowing through the machine and a relatively thick bottom section for insertion into the slot. The blade is welded to the hub at the interface of the thick bottom section and the hub.

DESCRIPTION OF THE PREFERRED EMBODIMENT

Figure 2:
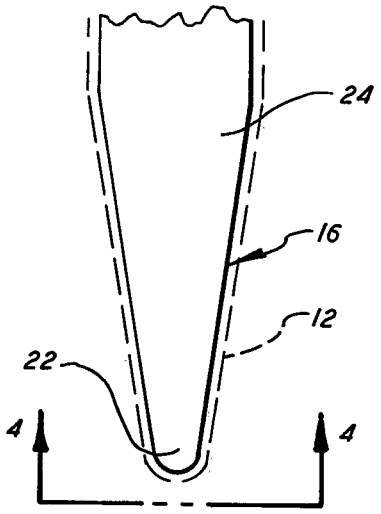
FIG. 2 Prior Art
FIG. 2 is a view similar to that of FIG. 1, illustrating a prior art blade.
Figure 4:
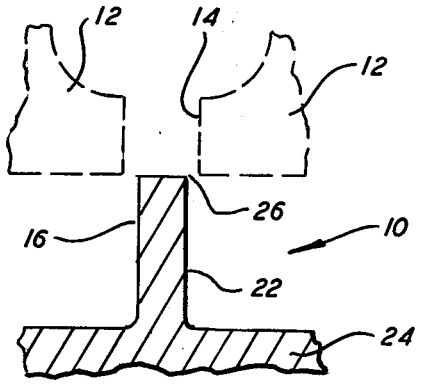
FIG. 4 Prior Art
FIG. 4 is a sectional view taken along line 4—4 of FIG. 2.
Figure 5:
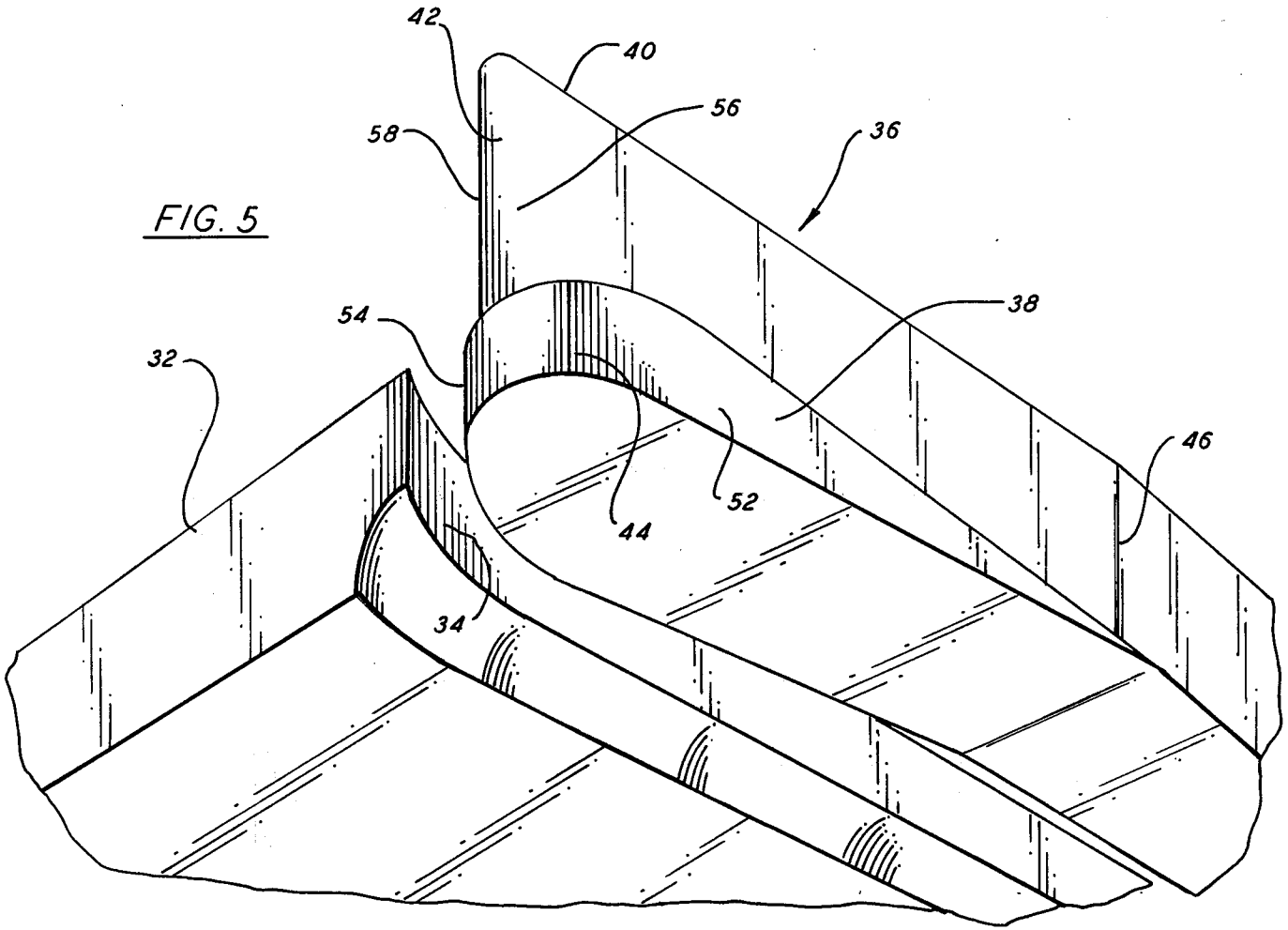
FIG. 5 is a perspective, partially exploded view of a blade mounted within an impeller hub in accordance with the present invention.

Referring now to the drawings, and in particular to FIGS. 2 and 4 thereof, there is disclosed a welded impeller in accordance with the prior art. In particular, impeller 10 includes a hub portion 12 having a slot 14 formed therein. A blade 16 is placed over slot 14 of hub 12 and welded to the hub at the hub blade interface 26. With particular reference to FIG. 2, it will be noted that the front of the leading edge of the blade is comprised of a relatively thin section 22. As shown in FIG. 5, section 22 extends axially only a small distance when compared to the total length of the blade. The remaining portion 24 of blade 16 is comprised of a relatively thick section.

In welding the blade shown in FIG. 2 to hub 12, problems have sometimes resulted due to the heat generated in the welding process burning the relatively thin leading edge portion of the blade, with resultant damage, or in severe cases, destruction of the blade.

Figure 1:
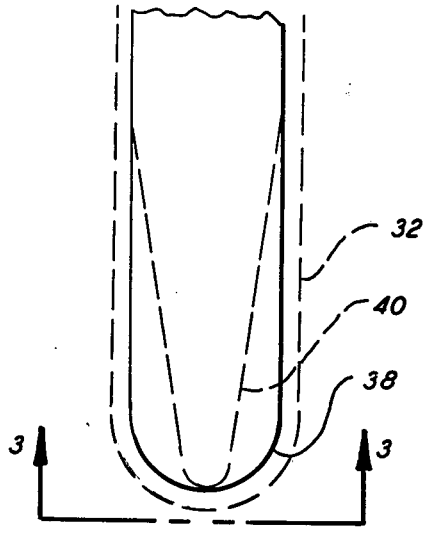
FIG. 1 is a bottom plan view of a blade in accordance with the present invention.
Figure 3:
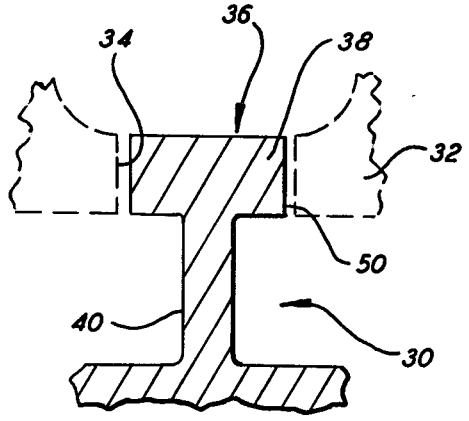
FIG. 3 is a sectional view taken along line 3—3 of FIG. 1.

To eliminate the foregoing problem, the blade illustrated in FIGS. 1 and 5 is employed in the impeller of FIG. 3.

In particular, impeller 30 includes a hub 32 having a slot 34 formed therein. A blade 36 having a lower or bottom portion 38 and a top portion 40 is attached to the hub by welding. With particular reference to FIG. 3, it will be noted lower portion 38 of blade 36 is inserted into slot 34 formed in hub 32. The blade is secured within slot 34 by welding the blade at the hub blade interface 50.

With particular reference to FIGS. 1 and 5, it will be observed top portion 40 of blade 36 is defined by a relatively thin section at the leading edge 42 of the blade. Bottom portion 38 of the blade includes a relatively thick section at the leading edge 44 of the blade. As used herein the term "thick" relates to the distance between surfaces 52 and 54 of the bottom section 38 and the word "thin" relates to the distance between surfaces 56 and 58 of top section 40. It is the relatively thick bottom section of the blade which is inserted into the hub (as shown in FIG. 3) and is welded thereto. The relatively thick bottom portion can withstand the heat generated during the welding process and is not damaged thereby. The aerodynamic characteristics of the blade are retained by providing the relatively thin, top section at the leading edge of the blade. It should be understood that the axial length of the leading edge of the blade is relatively small when compared to the total axial length of the blade. In the blade shown in FIG. 5, the leading edge terminates at point 46 whereat the thickness of the top section 40 of the blade substantially equals the thickness of the bottom section 38. It has been found that the leading edge of the blade should be relatively thin when compared to the remaining portion of the blade to achieve maximum aerodynamic performance.

With particular reference to FIG. 5, it will be noted that the bottom section of the blade is preferably tapered with the widest portion thereof being at the leading edge thereof. The taper ends at the portion 46 of the blade whereat the thickness of the top section has increased so that such thickness equals the thickness of the bottom portion. It is only the tapered portion of the bottom portion of the blade that is inserted into the slot formed in the impeller hub. The remaining portion of the blade is welded to the hub in the manner illustrated by FIGS. 2 and 4. A taper of 8° has been found particularly satisfactory. The taper is provided to eliminate a stepped surface heretofore defining the axial terminal point of the leading edge of the blade. The elimination of the step improves the quality of the welded joint obtained at the blade-hub interface.

By providing a blade as disclosed herein, the aerodynamic performance of the impeller can be maintained, without limiting the use of welding techniques for joining the blade to the hub to blades having relatively thick leading edges.

While a preferred embodiment of the present invention has been described and illustrated, the invention should not be limited thereto but may be otherwise embodied within the scope of the following claims.

What is claimed is:

1. A blade for a turbomachine comprising:

a leading edge formed of a relatively thin top section for contacting the fluid flowing through said machine, and a relatively thick bottom section, with said bottom section being tapered from the front of the leading edge of the blade to the end of the leading edge, with the widest portion of the bottom section being at the front of the leading edge.

2. An impeller for a centrifugal machine comprising:

a hub having at least one slot form therein; and a blade for mounting in the slot, the leading edge of the blade comprised of a relatively thin top section in contact with the fluid flowing through said machine, and a relatively thick bottom section for insertion into said slot, with the blade being welded to said hub at the interface of said thick bottom section and said hub, said relatively thick bottom section being tapered from the front of the leading edge of the blade to the end of the leading edge, with the widest portion of the bottom section being at the front of the leading edge.

* * * * *